US005706731A

United States Patent [19]

Francille et al.

[11] Patent Number: 5,706,731

[45] Date of Patent: Jan. 13, 1998

[54] INTERMEDIATE PRINTING SLEEVE HAVING AIR NOZZLES AND MEANS FOR SELECTIVELY CLOSING THE NOZZLES

[76] Inventors: Philippe Francille, "Callet", F-33240 Saint Romain la Virvee; Jean Francille, Lieu-dit Laroque, F-33910 Saint Ciers d'Abzac, both of France

[21] Appl. No.: 555,712

[22] Filed: Nov. 14, 1995

[30] Foreign Application Priority Data

Nov. 14, 1994 [FR] France ..... 94 13801

[51] Int. Cl.[6] ..... B41F 27/14

[52] U.S. Cl. ..... 101/375; 492/4; 492/48

[58] Field of Search ..... 101/216, 217, 101/375, 376, 401.1; 492/4, 48, 56; 29/895.23

[56] References Cited

U.S. PATENT DOCUMENTS

| | | | |
|---|---|---|---|
| 4,178,664 | 12/1979 | McLoughlin | 492/48 |
| 4,378,622 | 4/1983 | Pinkston et al. | 101/376 |
| 4,381,709 | 5/1983 | Katz | 492/4 |
| 5,216,954 | 6/1993 | Thompson | 101/375 |
| 5,481,975 | 1/1996 | Schulz | 101/375 |

FOREIGN PATENT DOCUMENTS

| | | |
|---|---|---|
| 0 546 973 | 6/1993 | European Pat. Off. . |
| 25 42 748 | 4/1976 | Germany . |

*Primary Examiner*—Stephen R. Funk
*Attorney, Agent, or Firm*—Young & Thompson

[57] ABSTRACT

A flexographic printing cylinder comprises a hollow support cylinder with a supply of compressed air to within the hollow support cylinder. Nozzles pass through the support cylinder to convey the compressed air from the inside to the outside of the support cylinder. An interpolated sleeve tightly fits over the support cylinder, and a thin sleeve tightly fits over the interpolated sleeve. Nozzles extend through the interpolated sleeve in registry with the nozzles through the support cylinder to convey compressed air to the thin sleeve. Structure is provided for selectively opening and closing the nozzles of the interpolated sleeve. That structure can be a ring rotatable on the interpolated sleeve, the ring having nozzles therethrough which align with the nozzles through the interpolated sleeve in one rotated position of the ring and which misalign with the nozzles through the interpolated sleeve in another rotated position of the ring so that the ring in that latter position closes the nozzles through the interpolated sleeve.

6 Claims, 2 Drawing Sheets

INTERMEDIATE PRINTING SLEEVE HAVING AIR NOZZLES AND MEANS FOR SELECTIVELY CLOSING THE NOZZLES

FIELD OF THE INVENTION

The present invention concerns a sleeve-holder interpolated sleeve for a machine, in particular a flexographic machine, and the disposition of a complete printing cylinder.

BACKGROUND OF THE INVENTION

Flexographic printing machines include several successive sets of printings depending on the number of colors, the role of each set being to print in the given color attributed to it an image so as to obtain the graphic representation in the desired colors.

These machines have highly significant printing capacities, although they produce at high rates images having good graphic quality. Also, the operators need to frequently change the cylinders bearing the plates.

So as to gain time and save money, the images are borne by plate-holder sleeves or rubber-lined sleeves which are directly etched with a laser in the thickness of the lining.

Thus, it is possible to gain precious time so as to carry out production changes; the plates are prepared, that is mounted and adjusted and then secured to the sleeve. Then the etched or plate-holder sleeves are mounted on additional cylinders while a first set is in place and functions on the machine.

During changing, the cylinders and their sleeves are removed from the machine, whereas the set of cylinders and stand-by sleeves are then placed on the machine.

It then remains to adjust the machine, that is to adjust the movement of the strip for printing from one group to another so that there is a superimposition of printings in each color. It can be readily understood, if this concerns a different image but with a given development, that two sets of metal support cylinders are required.

Thus, the number of cylinders must be doubled, failing which it is essential to stop the machine, remove the used plates, position the new ones on the sleeves, which is impossible from the point of view of profitability.

This operation thus constitutes an obvious improvement.

Therefore, it can be seen that the investment in sets of double cylinders is already an advantageous solution, but one that still remains highly costly.

Nevertheless, the lined or plate-holder sleeves are thin and need a large number of support cylinders so as to cover the range of required developments. The rectified metal cylinders are expensive and the investment of the cylinders supply of a flexographic machine is extremely high, all the more so where colors are involved.

One first solution for reducing the supply was proposed by the Applicants in the French patent No. 94 06417 and consists of producing thick sleeves made of a suitable material so as to exhibit sufficient hardness, having perfect time-behavioral qualities and being suitable for rectification when they need to support glued plates or be suitable for hooking a rubber lining for a subsequent laser etching.

This extremely attractive solution makes it possible to reduce the investment in metal support cylinders, as the thick composite sleeves are cheaper. Moreover, they are much easier to handle by virtue of being much lighter than the metal cylinders.

For current standard machine widths, a sleeve made of a composite material may be carried by a single person without infringing the laws relating to work, irrespective of the diameter in the current range. This avoids all handlings with a lifting block with all the associated drawbacks. Owing to this, it becomes, not merely pointless in having a set of metal support cylinders covering each development and the immediately higher developments, but moreover the second set of cylinders in the same development is suppressed.

Thus, it merely suffices to set up a reduced supply of metal support cylinders with gaps of one or several tens of developments and invest in sleeves with a given inner diameter, but covering the intermediate developments with a doubled number if it is desired to prepare the plates previously when the replacement development is identical to the current development.

Of course, if the developments are different but when the inner diameter of the sleeve is identical, that is when the development is situated in the development gap between two consecutive sets of metal support cylinders, one can readily understand the importance of these thick sleeves; in fact, it is possible to leave the metal support cylinders in place, remove the used sleeves and mount the previously prepared new sleeves. The machine idle time is reduced to its minimum.

In fact, the operation for changing sleeves now becomes extremely easy owing to the use of support cylinders inside which air under pressure is introduced and evacuated by nozzles distributed over the periphery of the cylinder along a circle in a zone situated immediately close to the end of the support cylinder by which said sleeve is introduced or removed.

The air, under a pressure of several bars, forms an air mattress between the outer surface of the metal support cylinder and the sleeve, extremely slightly expanding the latter but sufficiently so that it slides easily when moving on said support cylinder. As soon as the introduction of air under pressure inside the cylinder is interrupted, the sleeve is clad under the effect of its own elasticity on the support cylinder. It has been possible to observe that the radial clamping force on the entire surface ensures a full immobilization of the sleeve on the support cylinder in all cases, this being quite sufficient for the application in question.

If this solution of thick sleeves constitutes considerable progress compared with the solutions of the prior art by reducing the supply of metal support cylinders, providing considerable ease of handling, significant gains in time in mounting and the facility of placing and resting on the support cylinders, it nevertheless still means that, for a given development, it is essential to have two sets of sleeves. The excess cost is also proportional to the thickness, even if this proportionality is not linear.

SUMMARY OF THE INVENTION

Thus, the aim of the present invention is to provide interpolated sleeves which resolve this problem of the double set in a given development and which more generally make it possible to resort to using thin lined or plate-holder sleeves and laser-etched sleeves for all the developments, while requiring a reduced supply of metal support cylinders. The thin sleeves are renewed for each plate as they cannot be recharged with rubber or risk being damaged when placing the plate.

To this effect, the purpose of the present invention concerns fitting a flexographic printing complete cylinder comprising a hollow support cylinder with a given diameter, provided to be driven in rotation and equipped with a compressed air internal feed with traversing nozzles, fitted according a given angular distribution, roughly at the periphery along a circle immediately closed to the feeding end, and which is characterized in that it comprises at least one interpolated sleeve with an internal diameter compatible with the external diameter of a thin sleeve beating the image for a radially tight mounting whose external diameter is equal to that of sought-after development, said interpolated sleeve comprising nozzles roughly along a circle and having the same angular distribution as that of the support cylinder and means for blocking off these nozzles so as to enable this interpolated sleeve to be mounted on the support cylinder.

According to one preferred embodiment, the blocking off means include a translation-fixed mounted ring, especially by means of a fixed ring, along the longitudinal axis of the interpolated sleeve and mobile in rotation between two positions, namely open and closed, in a projection fitted in line with the nozzles of the interpolated sleeve, said ring being fitted with nozzles having the same angular distribution as that of the nozzles of the support cylinder and interpolated sleeve with the open position corresponding to the coincidence of the nozzles of the interpolated sleeve with the nozzles of the ring and a closed position in which the nozzles of the ring are offset with respect to those of the sleeve.

According to this embodiment, the ring includes gaskets so as to avoid any compressed air leaks occurring between the ring and the sleeve and the ring is mounted in a projection fitted from the internal periphery.

According to one embodiment variant, the blocking off means include hollow fixed inserts traversing the thickness of the interpolated sleeve, said inserts having an angular distribution identical to that of the nozzles of the support cylinder, said inserts being tapped so as to receive movable threaded bolts.

In the case of several coaxial interpolated sleeves, these sleeves include indices so as to allow for the alignment of the various nozzles along radial directions.

The invention also concerns the interpolated sleeve for implementing the previously mentioned disposition.

The advantages linked to the interpolated sleeves are practical as firstly storage is reduced and secondly the "trips" of thick sleeves to be relined and etched are eliminated. This affects the costs of investment and production, both via a reduction of storage and management costs, but also handling costs and especially by a new reduction of machine idle time.

BRIEF DESCRIPTION OF THE DRAWINGS

The present invention is described hereafter according to a particular embodiment with variants with reference to the accompanying drawings on which.

DETAILED DESCRIPTION OF THE INVENTION

Figure 1:
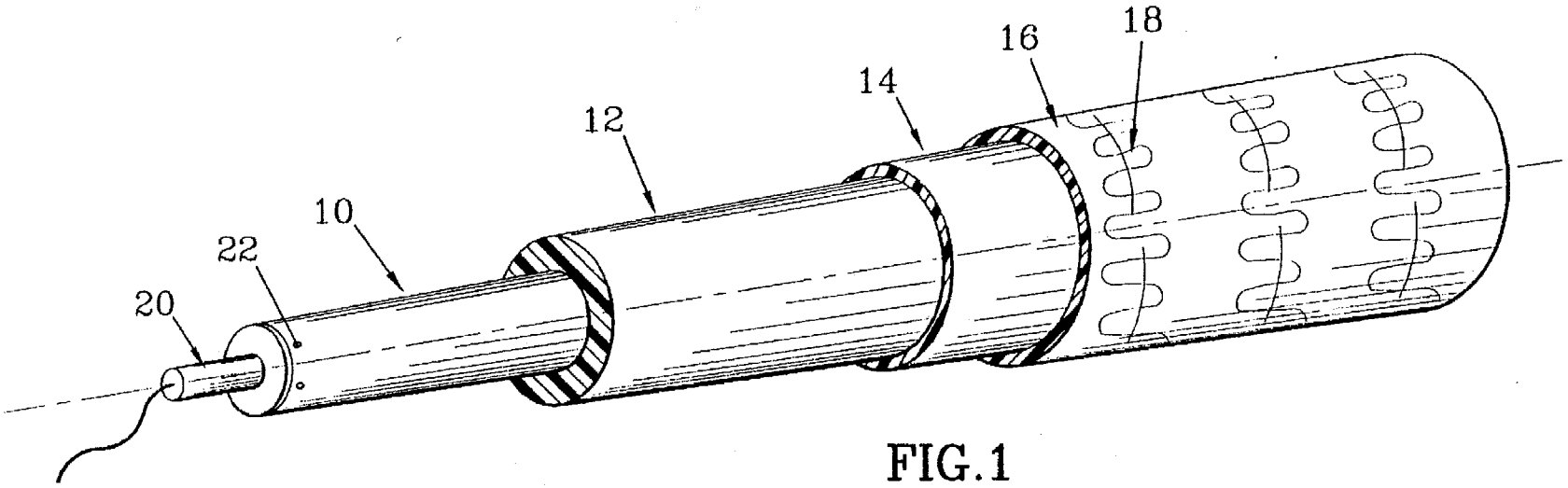
FIG. 1 is a diagrammatic perspective view of a unit comprising a metal support cylinder, an interpolated sleeve and a thin sleeve.

FIG. 1 shows the coaxial mounting of the metal support cylinder 10, the interpolated sleeve 12, the thin sleeve 14 on which represented under the reference 16 is either a rubber lining etched with the image 18, or an actual printing plate with the same image as decided by the user and the needs dictated by the type of image.

The central conduit 20 for introducing compressed air is generally fitted coaxially to one of the axes of the metal support cylinder.

Figure 2:
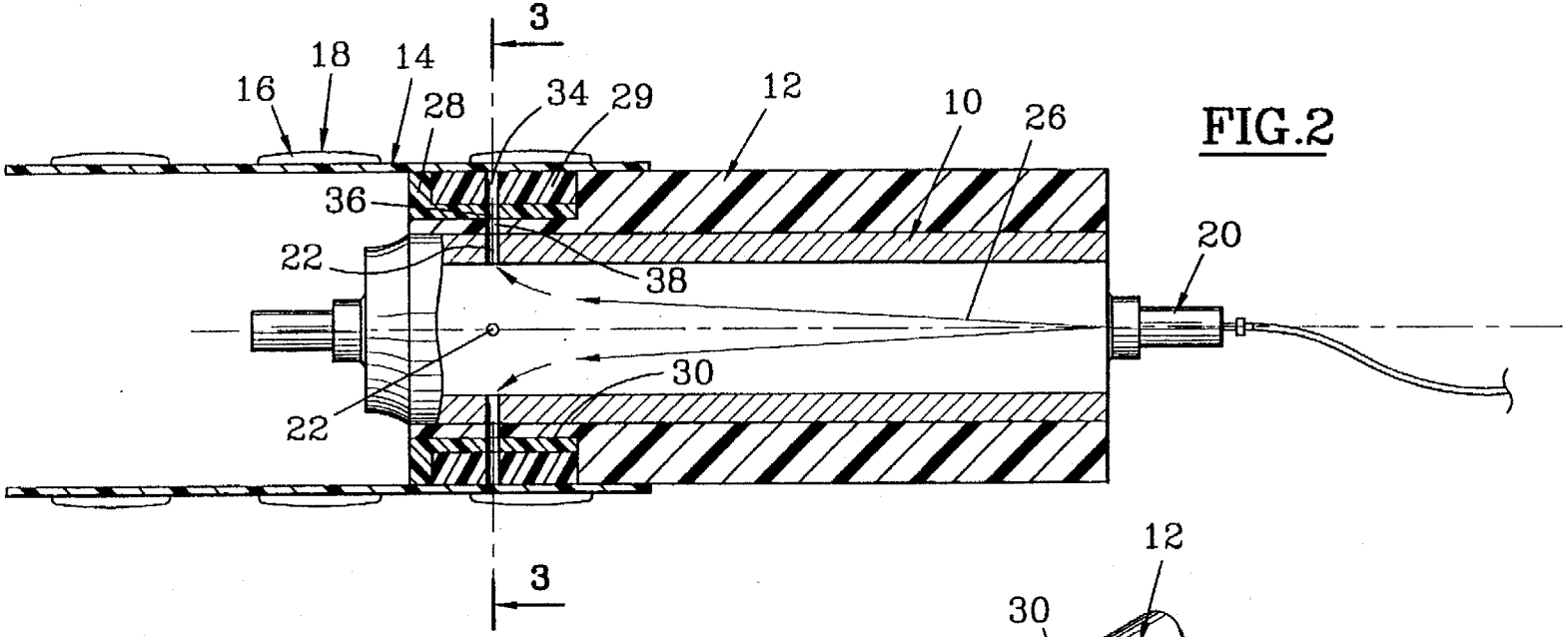
FIG. 2 is a longitudinal cutaway view of a preferred embodiment of the invention.

FIG. 2 bears identical references. The support cylinder is made of metal and the interpolated sleeve and the thin sleeve are made of a polymer material.

The interpolated sleeve is preferably produced according to the instructions of the French patent No. 94 06417.

The metal support cylinder 10 comprises the nozzles 22 regularly distributed along a circle opening at the periphery of said cylinder so as to place the inside of the cylinder in communication with the outside, the air path being represented by the arrows 26.

The intermediate sleeve 12 comprises a fixed ring 28 fixed with respect to the body of the intermediate sleeve and a mobile ring 29 freely rotating on the fixed ring 28. The fixed ring has an external diameter equal to that of the external diameter of the sleeve, and an internal diameter equal to the diameter of a projection 30 fitted at the end of the intermediate body.

This fixed ring has a reduced diameter over one portion of its length equal to approximately the inner diameter of the mobile ring.

The mobile ring 29 has an outer diameter equal to the outer diameter of the body of the intermediate sleeve and the outer diameter of the fixed ring in its portion with a non-reduced diameter.

Nozzles 36, 34 are machined through the thickness of the reduced diameter portion of the fixed ring 28 and through the thickness of the mobile ring 29 respectively.

The body of the sleeve also bears nozzles 38 in the portion situated in line with the projection.

Figure 2A:
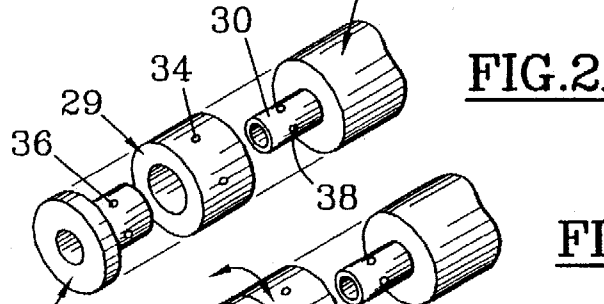
FIGS. 2A, 2B and 2C show exploded views of mounting of the ring of the sleeve of FIG. 2.
Figure 2B:
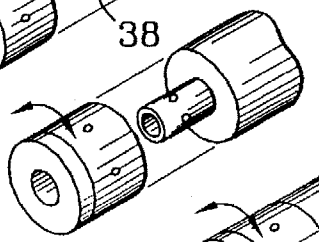
Figure 2C:
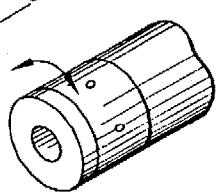

The mounting of this intermediate sleeve is effected according to the stages shown in FIGS. 2A to 2C. The mobile ring 29 is threaded onto the reduced diameter portion of the fixed ring 28 and then the fixed ring is assembled with its mobile ring coaxially to the projection 30 of the body of the intermediate cylinder by inserting a fixing device, such as a cyanoacrylate standard glue sold under the name "LOCTITE" while taking the precaution of making the nozzles 36 of the fixed ring coincide with the nozzles 38 of the projection 30 of the intermediate sleeve.

Thus, the mobile ring 29 can rotate with respect to the reduced diameter portion of the fixed ring, whereas this fixed ring is translation-immobilized, thus retaining the mobile ring.

Figure 3B:
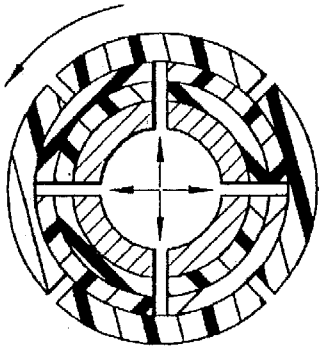
FIG. 3B is a transverse sectional view in the laying or removal position of the interpolated sleeve.
Figure 3A:
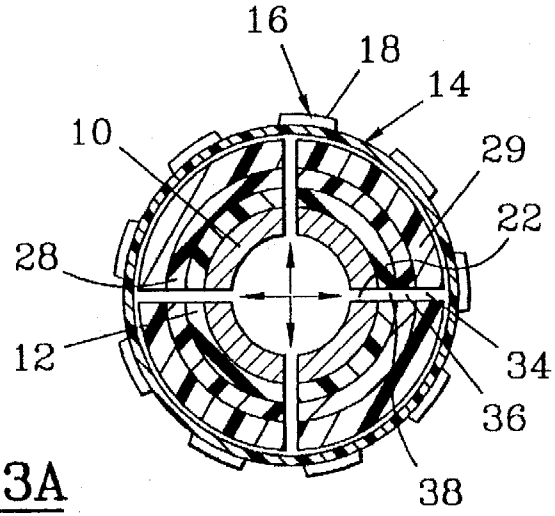
FIG. 3A is a transverse sectional view along the line 3—3 of the unit of FIG. 2 in the laying or removal position of the thin sleeve on the interpolated sleeve.

FIG. 3A shows the nozzles 22, 34, 36 and 38 distributed along identical angular sectors so that in a given position, they can be aligned.

Mounting of this assembly is carried out by introducing the under pressure air via the conduit 20 which passes through the nozzles 22 of the support cylinder 10.

The operator threads the intermediate sleeve 12 onto the end of the cylinder fitted with these nozzles 22. The air film enables this interpolated sleeve to be introduced easily.

The ring 29 is in the position shown on FIG. 3B, that is a position in which the nozzles 36 and 38 are in coincidence, but a position in which the nozzles 34 are not in coincidence with the nozzles 36 and 38.

The interpolated sleeve, once it has been fully and correctly positioned on the metal support cylinder, is locked on this support cylinder via rotation of the mobile ring 29 so as to bring the nozzles 36 and 38 in coincidence with the nozzles 34, that is in the position shown on FIG. 3A.

The thin sleeve 14 is then threaded onto the interpolated sleeve 12, as the air escaping through the four sets of nozzles forms a film of air which allows for relatively easy mounting.

Once this thin sleeve has been correctly positioned, the operator cuts off the feeding of compressed air, which immediately has the effect of locking the thin sleeve on the interpolated sleeve rendered integral on the metal support cylinder.

For removal, it merely suffices to carry out the operations mentioned below in reverse order.

If the development is identical, it suffices to feed the unit with compressed air, remove the thin sleeve without touching the ring so that the interpolated sleeve remains in place.

The operator can then mount a new thin sleeve.

When it is necessary to change development, the interpolated sleeve is withdrawn by rotating the ring and after removal of the used sleeve, the operator mounts a new sleeve.

If the development is significantly different from the diameter of the metal support cylinder and cannot be covered by an interpolated sleeve, it is appropriate to also change the metal support cylinder.

Figure 4:
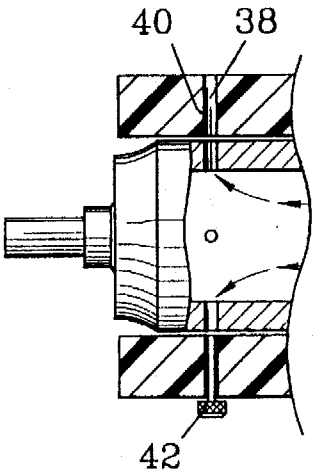
FIG. 4 is a fragmenting longitudinal cross-sectional view of an embodiment variant of the interpolated sleeve.

FIG. 4 shows a variant of the interpolated sleeve in which the ring has been suppressed and replaced by tapped cylindrical inserts 40 in which threaded bolts 42 can be screwed.

The threaded bolts play the same role as the ring and although less flexible in use, their cost price is less expensive.

With solely the knowledge of an expert in this field, it is possible to envisage there are other solutions for allowing the air to pass or block off the passage provided to this effect without departing from the context of the invention.

It is also possible to provide a numbered example which, even if does not necessarily give precise amounts in terms of absolute value, does nevertheless represent the scale and the ratios.

A printer wishes to meet an order of 10 different printing models in four colors with a given printing development, for example 820 mm. This printer only has one set of 680 mm metal support cylinders, namely fifteen developments smaller than that of the order. Thus, there are 40 etched plates and 10 machine changes; he then has the opportunity to carry out the following solutions.

FIRST SOLUTION

Purchase of 4 metal support cylinders, size 820 mm.

For a given machine width, the price is:

7,000 *francs*×4=28,000 *francs*.

DRAWBACK

The printer needs to stop his machine after each printing, remove the cylinders and the plates of these cylinders, reposition the new plates of the next printing. Stoppage of 5 to 6 hours, depending on the manual skill of the operators.

At the hourly cost of a 4-color machine, the loss is:

800 *francs*×55=44,000 *francs*.

As mentioned above, it is preferable to invest in two sets of cylinders, namely 56,000 francs.

SECOND SOLUTION

Purchase of two sets of thick (22 mm) composite sleeves at the price of 3,200 francs.

3,200×8=25,600 *francs*.

There is then a gain concerning the investment with respect to the metal solution as handling is easy. Moreover, the metal support cylinders remain on the machine and it suffices to place and replace the sleeves on the cylinders, which again procures a significant gain of time A problem is posed when the thick sleeves are directly lined with rubber as the present operation of 10 successive different printings requires that all the thick sleeves be ready for each printing.

This solution does have advantages but mainly for plate-holder sleeves.

THIRD SOLUTION

Purchase of 4 interpolated sleeves, thickness 21 mm, and 20 thin plate-holder or lined sleeves, namely:

(3,800×4)+(850×20)=32,200 *francs*.

This solution is able to render profitable the machine as far as possible by optimizing the changes which only take several minutes, although the machine stoppage may be almost neglected on this occasion, irrespective of the technique retained, whether it concern a plate-holder, lined or etched sleeve. Moreover, handling is further reduced since the thin sleeves are extremely light and the positioning is also extremely easy.

For an investment of the same type as for the second solution, only the interpolated sleeve is able to gain concerning machine immobilization, time and laying and placing quality, regardless of the printing plate mode retained.

It is to be noted that the presence of an interpolated sleeve is able to act on the lining of the thin sleeve for also treating extremely close developments. Only extremely close developments are mentioned as the rubber is expensive and heavy, and moreover the quality of printing would be altered by an excessive thickness.

On the other hand, having regard to in particular the mechanical qualities of the interpolated composite sleeves, the price and the weight, it is possible to have several interpolated sleeves mounted coaxially. It can be understood immediately that with a set of metal support cylinders and several sets of interpolated sleeves and acting on the thickness of the lining of the thin sleeves, an extremely wide range of developments is covered.

This disposition is highly advantageous for this sphere of activity constituted by flexographic printing.

According to one shown embodiment, the ring is fitted in a projection machined from the inner periphery of the interpolated sleeve, but this projection may be fitted from the outer periphery.

To perfect the invention, it is possible to make the positioning index appear to facilitate the mounting and prior adjustment operations.

The interpolated sleeves are produced according to the instructions of the patent application FR-A- 94 06417.

Each sleeve includes a series of preferably honeycomb-shaped material layers embedded in a resin matrix. The production support is a metal cylinder corrected to the diameter of the subsequent support cylinder.

Thus, the peripheral inner surface has a polished aspect.

The outer surface is corrected to the precise diameter allowing for the tight mounting of the thin sleeve.

The composition of the resin is adapted to provide the sleeve with a calculated contraction which ensures a radially clamped mounting. For mounting a ring, a type of mechanical machining known to operators in this field is used.

For mounting with inserts, the latter are previously embedded in the layers at the time of production at a sufficient depth so as to allow for the final correction of the interpolated sleeve.

We claim:

1. A flexographic printing cylinder comprising a hollow support cylinder, means to supply compressed air within the hollow support cylinder, nozzles passing through the support cylinder to convey said compressed air from an inside to an outside of the support cylinder, an interpolated sleeve tightly fitting over the support cylinder, a thin sleeve tightly fitting over the interpolated sleeve, nozzles extending through the interpolated sleeve in registry with said nozzles through said support cylinder to convey said compressed air to said thin sleeve, and means for selectively opening and closing said nozzles of said interpolated sleeve.

2. A flexographic printing cylinder according to claim 1, wherein said opening and closing means comprise a ring rotatable on said interpolated sleeve, said ring having nozzles therethrough which align with said nozzles through said interpolated sleeve in one rotated position of said ring and which misalign with said nozzles through said interpolated sleeve in another rotated position of said ring whereby said ring closes said nozzles of said interpolated sleeve in said another position of said ring.

3. A flexographic printing cylinder as claimed in claim 2, and means fixing said ring against translation in a direction axially of said interpolated sleeve.

4. A flexographic printing cylinder as claimed in claim 2, said interpolated sleeve having an annular recess in one end of said interpolated sleeve, said ring being disposed in said recess and having an outer surface flush with an outer surface of said interpolated sleeve.

5. A flexographic printing cylinder as claimed in claim 1, wherein said opening and closing means comprise threaded bolts.

6. A flexographic printing cylinder as claimed in claim 1, all of said nozzles being disposed in a common plane perpendicular to an axis of said support cylinder.

* * * * *